US006449969B1

(12) United States Patent
Fujimoto et al.

(10) Patent No.: US 6,449,969 B1
(45) Date of Patent: Sep. 17, 2002

(54) METHOD FOR CONTROLLING COOLANT CIRCULATION SYSTEM

(75) Inventors: Masakazu Fujimoto; Takashi Okada, both of Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 41 days.

(21) Appl. No.: 09/665,675

(22) Filed: Sep. 20, 2000

(30) Foreign Application Priority Data

Sep. 21, 1999 (JP) ..... 11-266975

(51) Int. Cl.[7] ..... F25D 17/00; F24F 11/04

(52) U.S. Cl. ..... 62/180; 62/201; 165/247; 165/295

(58) Field of Search ..... 62/180, 185, 201, 62/99; 165/247, 295

(56) References Cited

U.S. PATENT DOCUMENTS 4,459,818 A * 7/1984 Kaya et al. ..... 62/210 X
4,461,635 A * 7/1984 Rudebeck ..... 62/210 X
4,769,998 A * 9/1988 Oswalt et al. ..... 62/98

FOREIGN PATENT DOCUMENTS

JP 60-4773 1/1985
JP 1-144760 10/1989

* cited by examiner

*Primary Examiner*—William Wayner
(74) *Attorney, Agent, or Firm*—Armstrong, Westerman & Hattori, LLP

(57) ABSTRACT

There is provided a method for controlling a coolant circulation system including a coolant circuit and a refrigerating or refrigerating/heating machine in which a portion of the coolant circuit passes through the refrigerating or refrigerating/heating machine and includes a coolant inlet and a coolant outlet provided at opposite ends thereof, with the output of the refrigerating or refrigerating/heating machine being controlled on the basis of a temperature of the coolant at either one of the coolant inlet or the coolant outlet of the coolant circuit, the control method comprising controlling a flow rate of coolant flowing in the coolant circuit on the basis of a coolant temperature at the coolant inlet.

7 Claims, 4 Drawing Sheets

COOLANT FLOW RATE [%]
100
50
0
50
100
COOLING LOAD [%]

ELECTRIC POWER [%]
ELECTRIC POWER FOR COOLANT PUMP
100
50
0
50
100
COOLING LOAD [%]

COOLANT FLOW RATE [%]
COOLANT FLOW RATE CONTROL
VARIABLE FLOW RATE CONTROL
100
60
50
0
50
100
COOLING LOAD [%]

ELECTRIC POWER [%]
AMOUNT OF ENERGY CONSUMPTION
100
50
25
0
50
60
100
COOLING LOAD [%]

METHOD FOR CONTROLLING COOLANT CIRCULATION SYSTEM

BACKGROUND OF THE INVENTION

The present invention relates to a coolant circulation system employed in, for example, air conditioning equipment, and, in particular, to a coolant circulation system in which there is provided a refrigerating machine or a refrigerating/heating machine for regulating the temperature of a coolant.

Heretofore, a so-called constant-flow system has been commonly employed. In such a system, the output of the system is controlled in response to a change in the load imposed on the system in such a manner that the output of the refrigerating machine or refrigerating/heating machine of the system is regulated, while the coolant flow is kept constant.

Thus, in the system, even though the heat consumption of the refrigerating/heating machine can be reduced, the amount of power consumed in driving a coolant circulating pump remains unchanged. With a view to reducing the power consumption of the pump, there have been proposed various flow-rate control methods which are designed to control the output of a coolant circulation pump. Following are some examples of such proposed methods.

1) A Method Wherein Flow-rate Control is Performed on the Basis of a Detected Differential Pressure Between Coolant Headers:

This method will be described below with reference to FIG. 4 illustrating a conventional coolant circulation system.

The coolant circulation system comprises a coolant circuit and an absorption refrigerating machine. The absorption refrigerating machine includes an evaporator 1, a regenerator 2, a heat supply pipe 3 for supplying a heat to the regenerator 2, a heat supply control valve 4 and a heat supply control 5. The coolant circuit includes a coolant circulation pipe 6, a portion of which passes through the evaporator 1 to chill the coolant, a coolant outlet temperature detector 7, a supply header 8, a return header 9, a flow-rate control pump 10 for circulating coolant, a pump flow-rate control 11, a differential pressure detector 12, an air conditioner (air heat exchanger) 13, and a coolant flow rate control valve (two-way valve) 14.

In the conventional system, the coolant outlet temperature detector 7 detects a temperature of a coolant (referred to as "coolant outlet temperature" hereinbelow), as it exits the evaporator 1 where it has been chilled, and transmits a signal indicating the detected temperature to the heat supply control 5. Dependent on the transmitted signal, the heat supply control valve 4 is caused to either open or close to thereby control a heat supply to the regenerator 2, whereby output control is performed for the refrigerating machine.

In the above-described operation, when a refrigeration load is reduced, the coolant flow rate is also reduced by the air conditioner coolant flow rate control valve (two-way valve) 14 in order to save the power consumption of the coolant pump. However, at this point in the operation, there is a tendency for the differential pressure between the supply header 8 and the return header 9 to increase in excess of that which is required. For this reason, the differential pressure is detected by means of the differential pressure detector 12, and the detected differential pressure signal is transmitted to the pump flow-rate control mechanism 11 to control the flow-rate-control pump 10 in order to maintain an optimum constant differential pressure at all times.

However, it is to be noted that in the above-described method disadvantages arise as follows:

① The differential pressure detector is costly.

② Because the differential pressure is subject to rapid or frequent variations, it is difficult to perform effective control.

③ When the coolant flow rate is controlled, variations in the coolant outlet temperature become greater than in a case where such control is not performed. Consequently, significant influence is exerted on the control of the output of the refrigerating machine. Consequently, it is likely that the refrigeration operation will tend towards instability.

④ As a result of ③, the coolant outlet temperature is likely to become excessively low. Accordingly, there is a danger of the coolant freezing.

⑤ When a cooling load is dramatically reduced, the flow rate of coolant is also reduced dramatically by operation of the flow-rate control valve 14. Consequently, functioning of the refrigerating machine is liable to cease due to a reduction or suspension of coolant supply.

2) A Method Wherein Control is Performed on the Basis of a Detected Difference Between the Coolant Outlet and Inlet Temperatures:

This method will be described below with reference to the coolant circulation system shown in FIG. 5.

In FIG. 5, reference numerals 1 to 11, 13 and 14 denote the same constituent elements as those shown in FIG. 4. Reference numeral 15 denotes a coolant outlet-inlet temperature difference detector. Rather than controlling the flow-rate control pump 10 so as to maintain an optimum differential pressure between the supply header 8 and the return header 9 as is the case in the system shown in FIG. 4, in the system shown in FIG. 5 a difference between the coolant outlet and inlet temperatures is detected by means of the coolant outlet-inlet temperature difference detector 15 which transmits a signal indicating a detected temperature difference to the pump flow-rate control 11 which functions to control the variable displacement pump 10, whereby the coolant flow-rate is varied in order to maintain the temperature difference constant.

However, since in this method the coolant outlet temperature functions to influence both refrigeration output control and coolant flow-rate control, following disadvantages are encountered:

① Control of refrigeration output and control of coolant flow-rate are interdependent, with the result that the system is likely to become unstable.

② Overall control of the system is liable to be inaccurate since two different types of control are performed on the basis of a single factor, i.e. the coolant outlet temperature.

③ As a result of ②, the coolant outlet temperature may be reduced to such an extent that the coolant freezes.

3) A Method Wherein the Coolant Flow Rate is Varied on the Basis of the Condition of a Refrigerator Output Controller:

In this method the coolant flow rate is controlled in proportion to the degree of opening of a heat supply control valve in an absorption refrigerating machine, for example. The heat supply control valve is controlled generally on the basis of the detected coolant outlet temperature. When the coolant outlet temperature falls, the degree of opening of the heat supply control valve is reduced and, at the same time, the coolant flow rate is reduced. However, since the refrigeration output does not change rapidly, there is a danger that the temperature of the coolant will continue to fall to such an extent that the coolant freezes.

Although the foregoing method has been described with regard to a case where control is performed on the basis of the coolant outlet temperature of the refrigerating machine, a method also exists in which a heat supply control valve is controlled on the basis of a detected coolant inlet temperature. However, this method is also not reliable and there remains a danger of the coolant freezing due to fluctuations in the coolant inlet temperature.

In view of the disadvantages of the above-described conventional control methods, an object of the present invention is to provide a control method for a refrigerating or refrigerating/heating machine by which the control of a coolant circulating pump can be performed smoothly.

SUMMARY OF THE INVENTION

According to the present invention, there is provided a method for controlling a coolant circulation system including a coolant circuit and a refrigerating or refrigerating/heating machine in which a portion of the coolant circuit passes through the refrigerating or refrigerating/heating machine and includes a coolant inlet and a coolant outlet provided at opposite ends thereof, with the output of the refrigerating or refrigerating/heating machine being controlled on the basis of a temperature of the coolant at either one of the coolant inlet or the coolant outlet of the coolant circuit, the method comprising controlling a flow rate of coolant flowing in the coolant circuit on the basis of a coolant temperature at the coolant inlet.

The output of the refrigerating or refrigerating/heating machine may be controlled on the basis of a temperature of coolant at the coolant outlet.

Further, the output of the refrigerating or refrigerating/heating machine may be controlled so that the temperature of coolant at the coolant outlet is maintained substantially constant, and during an intermediate-high cooling load operation, the flow rate of coolant is controlled so that the temperature of coolant at the coolant inlet is maintained substantially constant, whereas during a low cooling load operation, the flow rate of coolant is controlled to be maintained at a predetermined value.

In accordance with an embodiment, the coolant circuit passes through a heat exchanger. In the embodiment, the method comprises detecting a difference between pressures of the coolant at positions upstream and downstream of the heat exchanger, and canceling the control of the flow rate of coolant on the basis of the coolant temperature at the coolant inlet upon detection of a predetermined value of the pressure difference.

The above and other objects, features and advantages of the present invention will become more apparent from the following description of the preferred embodiments thereof, taken in conjunction with the accompanying drawings.

BRIEF DESCRIPTION OF THE DRAWINGS

FIG. 2(*b*) is a diagram showing a relationship between a cooling load and an electric power in the conventional control system.

FIG. 2(*c*) is a diagram showing a relationship between a cooling load and a coolant flow rate in a coolant circulation system in accordance with an embodiment of the present invention.

FIG. 2(*d*) is a diagram showing a relationship between a cooling load and an electric power in the control system of the embodiment.

DETAILED DESCRIPTION OF THE INVENTION

Embodiments of the present invention will be described below with reference to the accompanying drawings.

Figure 1:
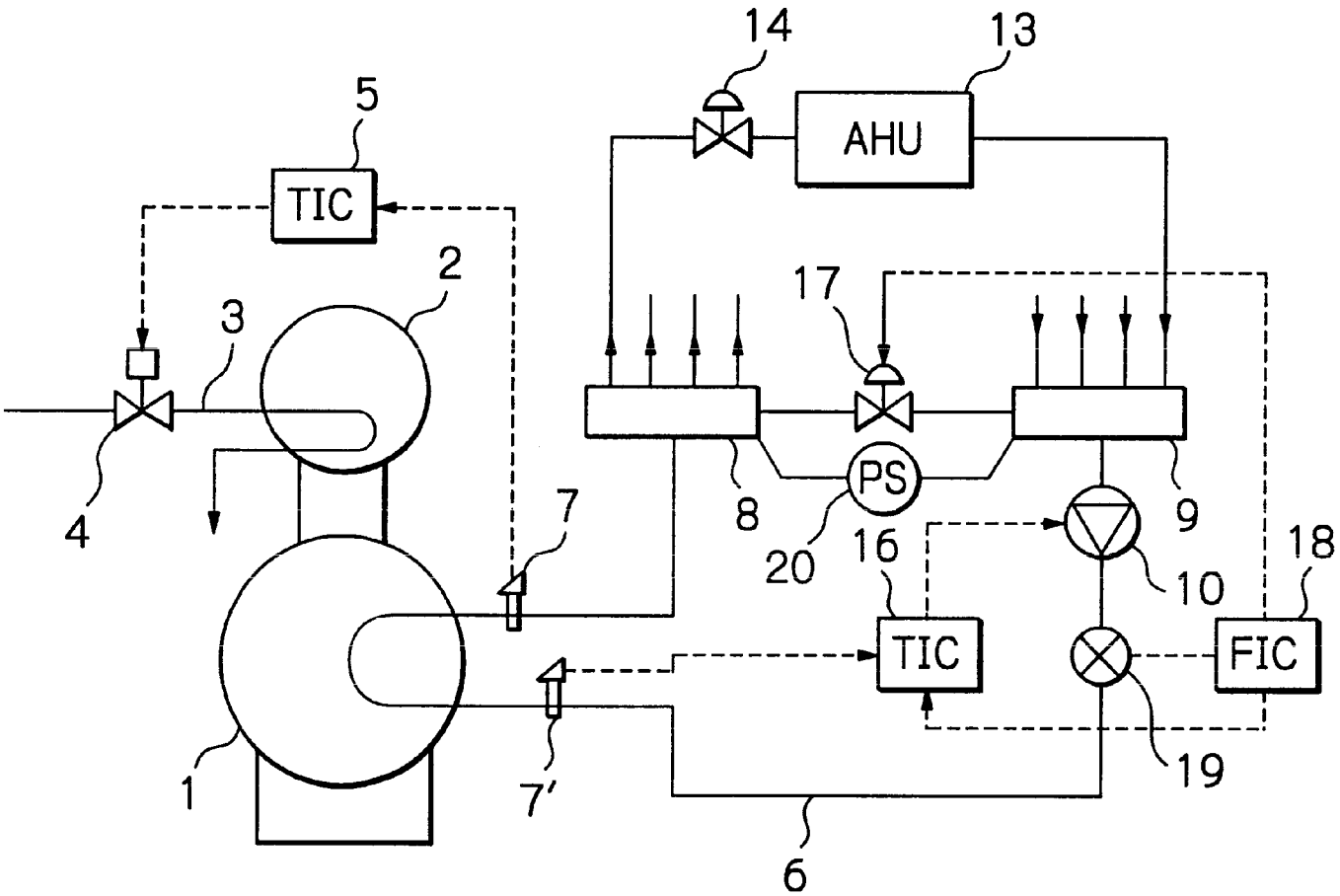
FIG. 1 is a diagram showing a coolant circulation system in accordance with an embodiment of the present invention, which system includes a coolant circuit and a absorption refrigerating machine.
Figure 4:
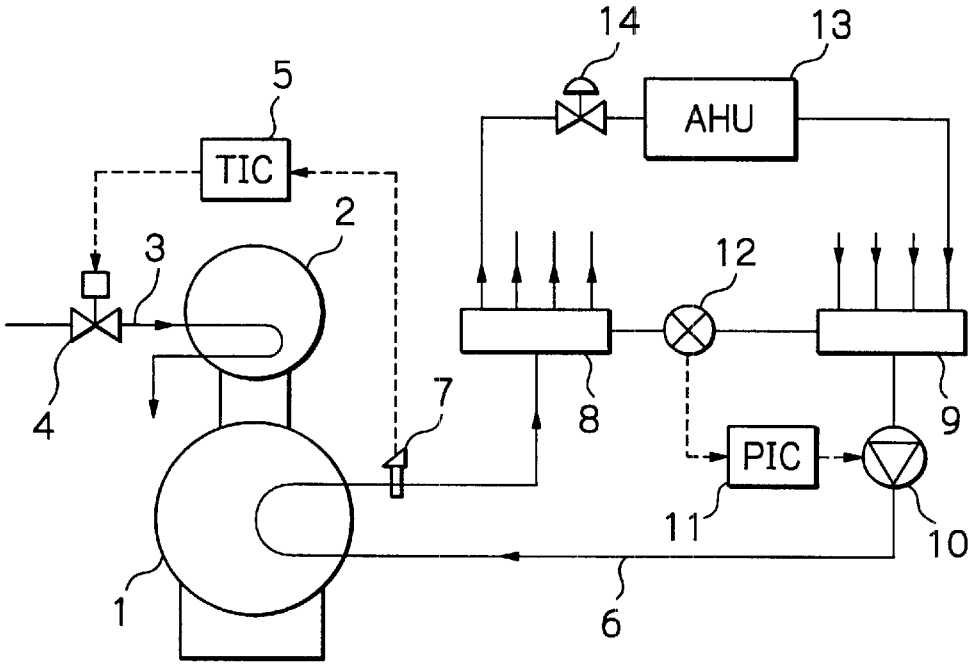
FIG. 4 is a diagram showing a conventional coolant circulation system including a coolant circuit and an absorption refrigerating machine.
Figure 5:
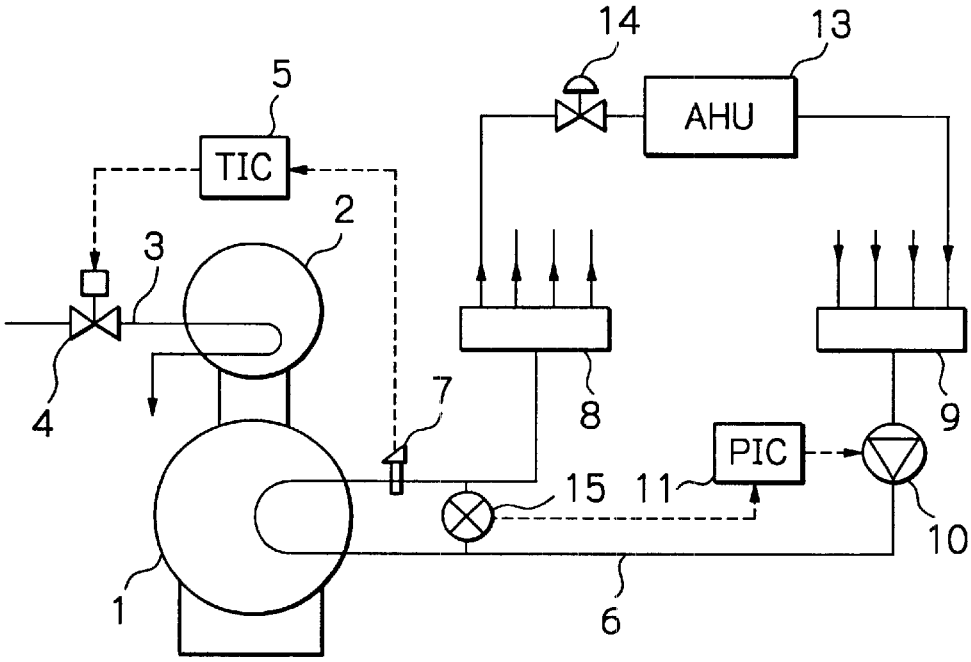
FIG. 5 is a diagram showing another conventional coolant circulation system.

The coolant circulation system shown in FIG. 1 has generally the same construction as that shown in FIGS. 4 and 5 and includes a coolant circuit and an absorption refrigerating machine. The absorption refrigerating machine includes an evaporator 1, a regenerator 2, a heat supply pipe 3 for supplying heat to the regenerator 2, a heat supply control valve 4, and a heat supply control 5. The coolant circuit includes a coolant circulation pipe 6, a portion of which passes through the evaporator 1 to chill the coolant, a coolant outlet temperature detector 7, a supply header 8, a return header 9, a flow-rate control pump 10 for circulating coolant, a pump flow-rate control 11, an air conditioner (air heat exchanger) 13, and a coolant flow rate control valve (two-way valve) 14.

The coolant system further includes a coolant inlet temperature detector 7', a pump control 16, a coolant header by-pass valve 17, a by-pass valve control 18, a coolant flow rate detector 19, and a coolant header differential pressure detector 20.

As described below, the above-described system is controlled in different ways in response to conditions of the cooling load, i.e., an intermediate-high cooling load and a low cooling load. In this specification, it is defined that, when the refrigerating machine is operating at 100% output capacity and the coolant inlet temperature is 12.0° C., the coolant outlet temperature is reduced to 7.0° C. with the difference between the inlet and outlet temperature being 5.0° C., the cooling load is 100%.

1) Intermediate-high Cooling Load (60 to 100%):

Under the intermediate-high cooling load, the temperature detector 7' detects the coolant inlet temperature and transmits a signal indicating the detected temperature to the pump flow-rate control 16 to control the pump 10, so as to maintain the coolant inlet temperature constant at 12.0° C. For example, when the cooling load is 80%, if the flow-rate is maintained at the same level as that in the operation under 100% cooling load, the coolant inlet temperature will become 11.0° C. However, upon detection of such a temperature by the temperature detector 7', the pump flow-rate control 16 controls the pump 10 so as to reduce the flow-rate of the coolant, whereby the coolant inlet temperature is maintained at 12.0° C. Thus, the power consumption of the coolant circulating pump can be accordingly reduced in proportion to the variation of the cooling load.

That is, flow-rate control is effected whereby in a cooling load ranging from 60 to 100%, the coolant inlet temperature is maintained at 12.0° C. and the coolant outlet temperature is maintained at 7.0° C.

2) Low Cooling Load (Less Than 60%):

The power consumption of the coolant circulating pump is proportional to the cube of the coolant flow rate. When the coolant flow rate is 60%, the pump power consumption is reduced to a level given by $$0.6^3 \times 100\% = 21.6\%$$

When the coolant flow rate is less than 60%, the energy-saving effect is minor relative to the reduction in the flow rate; and if the coolant flow rate is excessively low, there is a danger of the coolant freezing. For this reason, when cooling load is low, less than 60%, as opposed to pursuance of energy conservation, greater importance is attached to stability, with the coolant flow rate being maintained constant at a low level of 60%.

In this case, the coolant flow rate is detected by means of the coolant flow rate detector 19, and the detected flow rate signal is transmitted to the coolant header by-pass valve control 18 to effect control of the coolant header by-pass valve 17 in order to maintain the coolant flow rate constant at a low level.

3) Method of Switching Between an Intermediate-high Load Operation and a Low Load Operation:

During an intermediate-high load operation, the degree of opening of the coolant flow rate control valve 14 is controlled to be on the high valve-opening degree side, and the flow rate of the coolant is controlled in accordance with a cooling load. If the cooling load becomes low, the degree of opening of the coolant flow rate control valve 14 is reduced. The minimum rotational speed of the flow rate control pump 10 is set at a flow rate of 65%. However, when the degree of opening of the coolant flow rate control valve 14 is reduced, the coolant flow rate is likely to be reduced to fall below 60% undesirably. In this case, therefore, the coolant flow rate is detected by means of the coolant flow rate detector 19, and the detected flow rate signal is transmitted to the control unit 18 connected to the pump flow rate control 16 and the coolant header by-pass valve 17, whereby the flow rate control pump 10 is maintained at the minimum rotational speed, and also the flow rate of coolant flowing through the coolant flow rate detector 19 becomes 60%. When the load again increases, the coolant header by-pass valve 17 is operated to be closed fully. When the flow rate of coolant flowing through the coolant flow rate detector 19 has exceeded 60%, control reverts to the previous process.

4) Assurance of the Flow Rate of Coolant Flowing into the Air Conditioner:

In the system shown in FIG. 1, when the number of air conditioners, connected between the supply header 8 and the return header 9, is several tens of times or more, a limited number of air conditioners can be subjected to intensive loading, although the other air conditioners are being subjected to low loading, whereby the flow rate of the coolant is reduced so that the header differential pressure between the supply header 8 and the return header 9 may become excessively low, resulting in a failure to ensure a sufficient flow rate of coolant to those air conditioners which are subject to the intensive load. To prevent this problem, the differential pressure is detected with the coolant header differential pressure detector 20, and when the differential pressure falls below a set value, the rotational speed of the flow rate control pump 10 is fixed to a level necessary to ensure a sufficient flow rate of coolant for those air conditioners which are subject to the intensive load.

Figures 2A, 2B, 2C, 2D:
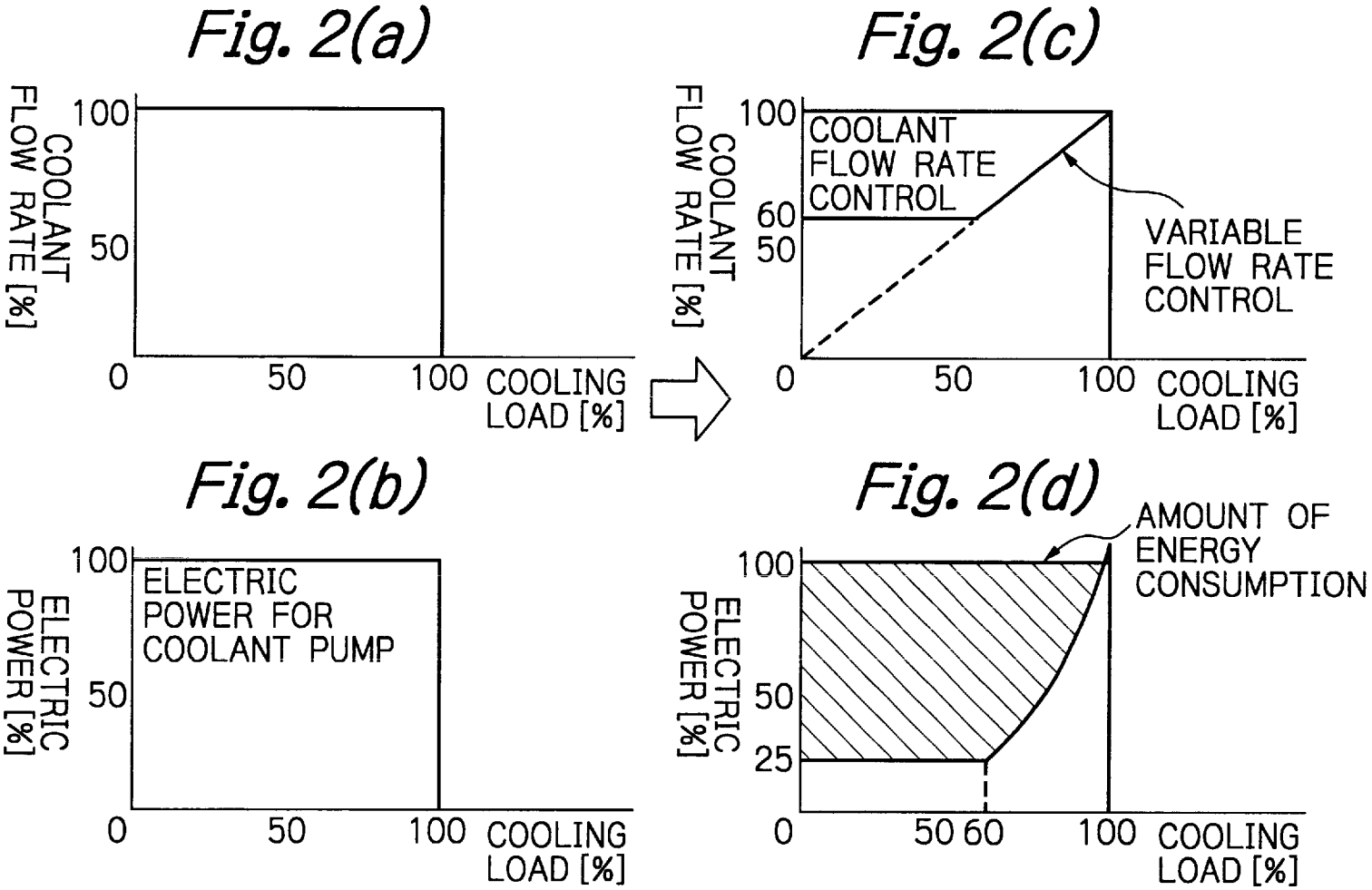
FIG. 2(*a*) is a diagram showing a relationship between a cooling load and a coolant flow rate in a conventional coolant circulation system.

FIGS. 2(*a*) to 2(*d*) are diagrams showing the relationships of coolant flow rate and electric power consumption relative to the cooling load under a flow-rate control operation in accordance with a conventional control method (FIGS. 2(*a*) and 2(*b*)), and relationships of coolant flow rate and electric power consumption relative to the cooling load under a coolant flow-rate control according to the present invention (FIGS. 2(*c*) and 2(*d*)).

In FIGS. 2(*a*) to 2(*d*), the abscissa axis shows the cooling load (%), and the ordinate axis shows the flow rate (%) in FIGS. 2(*a*) and 2(*c*) and electric power (%) in FIGS. 2(*b*) and 2(*d*).

According to the control method of the present invention, as shown in FIG. 2(*c*), control is effected such that, in the low-load region (less than 60%), the flow rate is maintained constant at a level of about 60%, and in the intermediate and high load region (60 to 100%), the coolant circulating flow rate control pump 10 is subjected to the above-stated flow rate control. Thus, as compared with the conventional control method shown in FIG. 2(*a*), the control method of the present invention is able to attain significant energy saving, as is made clear from the comparison between the electric power consumption shown in FIG. 2(*b*) and the electric power consumption shown in FIG. 2(*d*). The diagonally shaded area in FIG. 2(*d*) is equivalent to the amount of energy saved.

Figure 3:
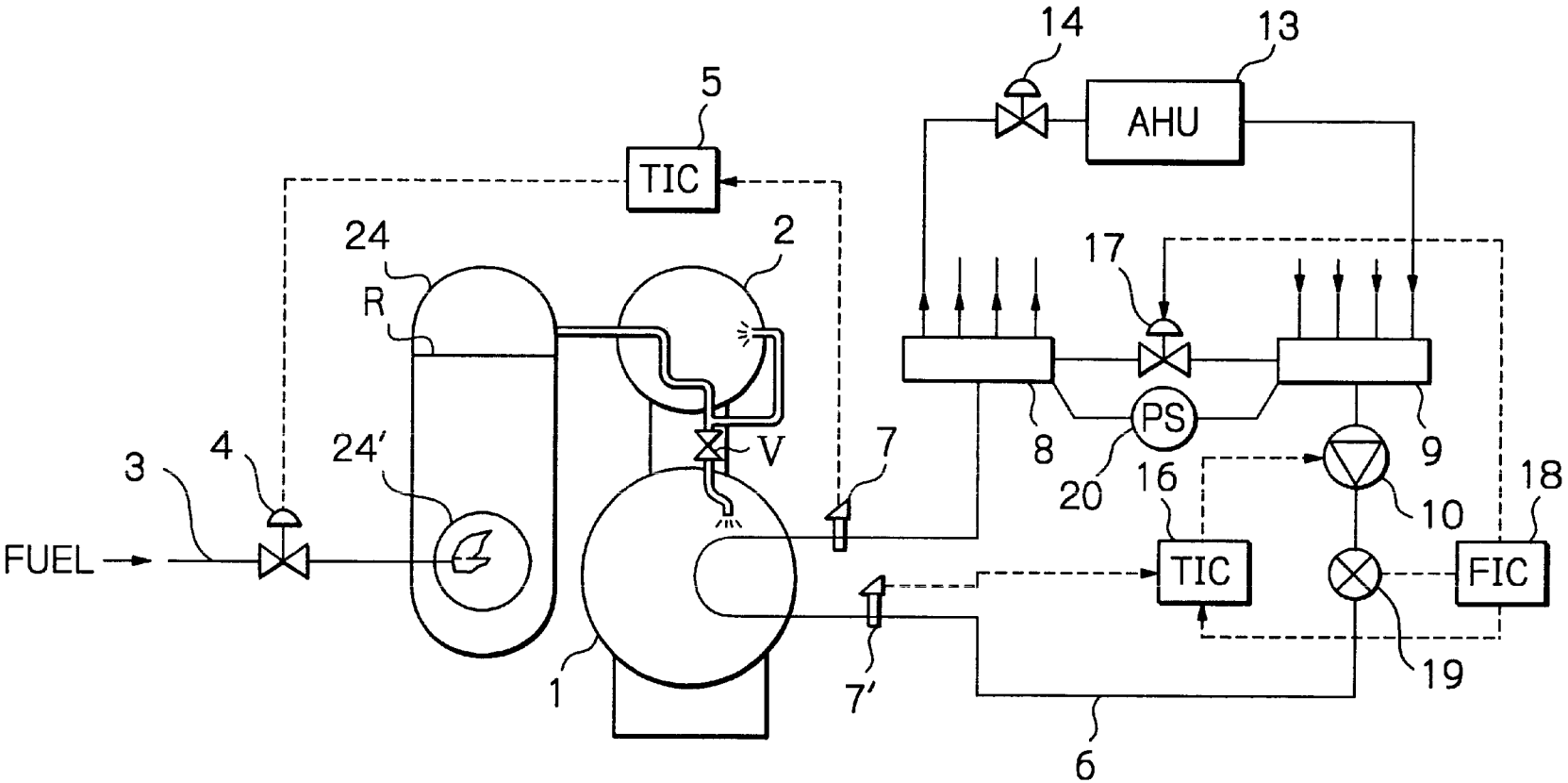
FIG. 3 is a diagram showing a coolant circulation system in accordance with another embodiment of the present invention which system includes a coolant circuit and a heating/refrigerating machine.

FIG. 3 is a diagram showing a coolant circulation system in accordance with another embodiment in which all the elements of the system are the same as those of the system shown in FIG. 1, with the exception that there are additionally provided a high temperature regenerator 24 and associated elements to constitute a refrigerating/heating machine. The high temperature regenerator 24 comprises a heater 24' which heats a refrigerant liquid R contained in the regenerator 24 to generate heated refrigerant vapor so that the vapor is supplied into the evaporator 1 and then directed towards a portion of the coolant circulation pipe 6 passing though the evaporator 1 to heat the coolant in the pipe. As shown, a valve V is provided in the pipe guiding the heated vapor from the high temperature regenerator 24 to the evaporator 1. The valve is closed when the coolant in the coolant circulation pipe 6 should be refrigerated so that the heated vapor is introduced into the regenerator 2 to heat the absorption liquid of the absorption refrigerating machine. Detailed explanation will be omitted with respect to construction and the function of the absorption refrigeration machine including the high temperature regenerator 24 or refrigerating/heating machine, as those are well known by those skilled in the art.

Although in the foregoing description, specific numerical values are mentioned in regard to the temperature, load, coolant flow rate, etc., it should be noted that the numerical values are dependent on various conditions.

It should also be noted that the present invention is not limited to the foregoing embodiments and can be modified in a variety of ways.

What is claimed is:

1. A control method for controlling a coolant circulation system including a coolant circuit and a refrigerating or refrigerating/heating machine in which a portion of the coolant circuit passes through the refrigerating or refrigerating/heating machine and includes a coolant inlet and a coolant outlet provided at opposite ends thereof, with the output of the refrigerating or refrigerating/heating machine being controlled on the basis of a temperature of the coolant at either one of the coolant inlet or the coolant outlet of the coolant circuit, the control method comprising:

controlling a flow rate of coolant flowing in the coolant circuit on the basis of a coolant temperature at the coolant inlet, wherein the output of the refrigerating or refrigerating/heating machine is controlled so that the temperature of coolant at the coolant outlet is maintained substantially constant, and during an intermediate-high cooling load operation, the flow rate of coolant is controlled so that the temperature of coolant at the coolant inlet is maintained substantially constant, whereas during a low cooling load operation, the flow rate of coolant is controlled to be maintained at a predetermined value.

2. A method according to claim 1, wherein the coolant circuit passes through a heat exchanger, the method comprising:

detecting a difference between pressures of the coolant at positions upstream and downstream of the heat exchanger, and canceling the control of the flow rate of coolant on the basis of the coolant temperature at the coolant inlet upon detection of a predetermined value of the pressure difference.

3. A control method for controlling a coolant circulation system including a coolant circuit and a refrigerating or refrigerating/heating machine in which a portion of the coolant circuit passes through the refrigerating or refrigerating/heating machine and includes a coolant inlet and a coolant outlet provided at opposite ends thereof, with the output of the refrigerating or refrigerating/heating machine being controlled on the basis of a temperature of the coolant at either one of the coolant inlet or the coolant outlet of the coolant circuit, the control method comprising:

controlling a flow rate of coolant flowing in the coolant circuit on the basis of a coolant temperature at the coolant inlet, wherein the output of the refrigerating or refrigerating/heating machine is controlled on the basis of a temperature of coolant at the coolant outlet, wherein the output of the refrigerating or refrigerating/heating machine is controlled so that the temperature of coolant at the coolant outlet is maintained substantially constant, and during an intermediate-high cooling operation, the flow rate of coolant is controlled so that the temperature of coolant at the coolant inlet is maintained substantially constant, whereas during a low cooling load operation, the flow rate of coolant is controlled to a predetermined value.

4. A method according to claim 3, wherein the coolant circuit passes through a heat exchanger, the method comprising:

detecting a difference between pressures of the coolant at positions upstream and downstream of the heat exchanger, and canceling the control of the flow rate of coolant on the basis of the coolant temperature at the coolant inlet upon detection of a predetermined value of the pressure difference.

5. A method for controlling a coolant circulation system including a coolant circuit and a refrigerating or refrigerating/heating machine in which a portion of the coolant circuit passes through the refrigerating or refrigerating/heating machine and includes a coolant inlet and a coolant outlet provided at opposite ends thereof, with the output of the refrigerating or refrigerating/heating machine being controlled on the basis of a temperature of the coolant at either one of the coolant inlet or the coolant outlet of the coolant circuit, the control method comprising:

controlling a flow rate of coolant flowing in the coolant circuit on the basis of a coolant temperature at the coolant inlet, wherein the coolant circuit passes through a heat exchanger, and the method includes the additional steps of:

detecting a difference between pressures of the coolant at positions upstream and downstream of the heat exchanger, and canceling the control of the flow rate of coolant on the basis of the coolant temperature at the coolant inlet upon detection of a predetermined value of the pressure difference.

6. A method according to claim 5, wherein the coolant circuit passes through a heat exchanger, the method comprising:

detecting a difference between pressures of the coolant at positions upstream and downstream of the heat exchanger, and canceling the control of the flow rate of coolant on the basis of the coolant temperature at the coolant inlet upon detection of a predetermined value of the pressure difference.

7. A method for controlling a coolant circulation system including a coolant circuit and a refrigerating or refrigerating/heating machine in which a portion of the coolant circuit passes through the refrigerating or refrigerating/heating machine and includes a coolant inlet and a coolant outlet provided at opposite ends thereof, with the output of the refrigerating or refrigerating/heating machine being controlled on the basis of a temperature of the coolant at either one of the coolant inlet or the coolant outlet of the coolant circuit, the control method comprising:

controlling a flow rate of coolant flowing in the coolant circuit on the basis of a coolant temperature at the coolant inlet, wherein the output of the refrigerating or refrigerating/heating machine is controlled on the basis of a temperature of coolant at the coolant outlet, wherein the coolant circuit passes through a heat exchanger, and the method includes the additional steps of:

detecting a difference between pressures of the coolant at positions upstream and downstream of the heat exchanger, and canceling the control of the flow rate of coolant on the basis of the coolant temperature at the coolant inlet upon detection of a predetermined value of the pressure difference.

* * * * *